US008952771B2

(12) United States Patent
Kiyono et al.

(10) Patent No.: US 8,952,771 B2
(45) Date of Patent: Feb. 10, 2015

(54) SWITCH AND ELECTRONIC DEVICE

(75) Inventors: Yasuhiro Kiyono, Nagaokakyo (JP); Toshihiro Naruo, Kyoto (JP)

(73) Assignee: OMRON Corporation, Kyoto (JP)

( * ) Notice: Subject to any disclaimer, the term of this patent is extended or adjusted under 35 U.S.C. 154(b) by 603 days.

(21) Appl. No.: 13/193,061

(22) Filed: Jul. 28, 2011

(65) Prior Publication Data

US 2012/0048694 A1 Mar. 1, 2012

(30) Foreign Application Priority Data

Aug. 25, 2010 (JP) ..... 2010-187996

(51) Int. Cl.
*H01H 9/00* (2006.01)
*H01H 9/20* (2006.01)
*H01H 23/20* (2006.01)

(52) U.S. Cl.
CPC ..... *H01H 23/205* (2013.01)
USPC ..... 335/179; 335/128; 335/170; 335/171; 335/234

(58) Field of Classification Search
CPC ..... H01H 3/20; H01H 7/00
USPC ..... 335/179, 128, 170, 171, 234; 200/553, 200/558, 559
See application file for complete search history.

(56) References Cited

U.S. PATENT DOCUMENTS 3,740,682 A * 6/1973 Schantz ..... 335/186
5,223,813 A * 6/1993 Cambreleng et al. ..... 337/66
5,889,457 A * 3/1999 Hsu et al. ..... 337/59

(Continued)

FOREIGN PATENT DOCUMENTS

CN 101794684 A 8/2010
JP 10-092269 A 4/1998
JP 11-167845 A 6/1999

(Continued)

OTHER PUBLICATIONS

Extended European Search Report for Application No. 11174704.4, mailed on Nov. 23, 2011 (6 pages).

(Continued)

*Primary Examiner* — Mohamad Musleh
(74) *Attorney, Agent, or Firm* — Osha Liang LLP

(57) ABSTRACT

This invention provides a switch in which the switch components are separately arranged at the portion where the switch components tend to be arranged in a concentrated manner in the housing without being collectively arranged in one region in the housing to achieve miniaturization and slimming, and in which the welding avoiding performance at the contact is enhanced to extend the lifespan, and an electronic device. A switch includes an operating element which is supported in a housing and which is oscillation operated to one side and the other side, a power supply switch mechanism 180 for bringing contacts of a movable piece and a fixed terminal facing each other in the housing into contact with each other to turn ON a power supply in cooperation with the ON operation when the operating element is oscillated to one side and ON operated, and a power supply reset mechanism for holding and releasing the ON state of the power supply switch mechanism, wherein the power supply reset mechanism is arranged on one side in an oscillation operating direction of the operating element, and the power supply switch mechanism is arranged on the other side in the oscillation operating direction of the operating element.

10 Claims, 15 Drawing Sheets

(56) References Cited

U.S. PATENT DOCUMENTS

| | | | |
|---|---|---|---|
| 2005/0275995 | A1 | 12/2005 | Noguchi et al. |
| 2010/0163382 | A1 | 7/2010 | Park |

FOREIGN PATENT DOCUMENTS

| | | | |
|---|---|---|---|
| JP | 2001-014982 | A | 1/2001 |
| JP | 3907759 | B2 | 4/2007 |
| TW | 366510 | | 8/1999 |

OTHER PUBLICATIONS

Search Report issued in corresponding Taiwanese Application No. 100112902, mailed Aug. 16, 2013 (12 pages).

English Patent abstract of Taiwanese Publication No. 366510 (1 page).

* cited by examiner

100 ··· SWITCH
120 ··· OPERATING ELEMENT
F1 ··· ONE SIDE (ON SIDE)
F2 ··· OTHER SIDE (OFF SIDE)

100 ··· SWITCH
120 ··· OPERATING ELEMENT
160 ··· RETURN SPRING
171 ··· SOLENOID
180 ··· POWER SUPPLY SWITCH MECHANISM
F1 ··· ONE SIDE (ON SIDE)
F2 ··· OTHER SIDE (OFF SIDE)

100 ··· SWITCH
120 ··· OPERATING ELEMENT
160 ··· RETURN SPRING
171 ··· SOLENOID
F1 ··· ONE SIDE (ON SIDE)
F2 ··· OTHER SIDE (OFF SIDE)

OFF
ON
ONLY OPERATING ELEMENT IS TURNED OFF
100 ··· SWITCH
120 ··· OPERATING ELEMENT
130 ··· ROTATION OPERATING BODY
132 ··· SWITCH OPERATION UNIT
134 ··· RETURN SPRING REGULATING PIECE
160 ··· RETURN SPRING
171 ··· SOLENOID
172 ··· MOVABLE MAGNETIC PIECE
180 ··· POWER SUPPLY SWITCH MECHANISM
F1 ··· ONE SIDE (ON SIDE)
F2 ··· OTHER SIDE (OFF SIDE)

200 ··· SWITCH
220 ··· OPERATING ELEMENT
F1 ··· ONE SIDE (ON SIDE)
F2 ··· OTHER SIDE (OFF SIDE)

200 ··· SWITCH
220 ··· OPERATING ELEMENT
233 ··· FORCED PRESSURIZATION PIECE
260 ··· RETURN SPRING
272 ··· MOVABLE MAGNETIC PIECE
280 ··· POWER SUPPLY SWITCH MECHANISM
281 ··· SPRING COUPLING BODY
F1 ··· ONE SIDE (ON SIDE)
F2 ··· OTHER SIDE (OFF SIDE)

200 ··· SWITCH
220 ··· OPERATING ELEMENT
271 ··· SOLENOID
272 ··· MOVABLE MAGNETIC PIECE

280 ··· POWER SUPPLY SWITCH MECHANISM
281 ··· SPRING COUPLING BODY
F1 ··· ONE SIDE (ON SIDE)
F2 ··· OTHER SIDE (OFF SIDE)

200 ··· SWITCH
220 ··· OPERATING ELEMENT
280 ··· POWER SUPPLY SWITCH MECHANISM
281 ··· SPRING COUPLING BODY
289 ··· DISPLACEMENT SUPPORTING PORTION
F1 ··· ONE SIDE (ON SIDE)
F2 ··· OTHER SIDE (OFF SIDE)

200 ··· SWITCH
220 ··· OPERATING ELEMENT
233 ··· FORCED PRESSURIZATION PIECE
281 ··· SPRING COUPLING BODY
F1 ··· ONE SIDE (ON SIDE)
F2 ··· OTHER SIDE (OFF SIDE)

SWITCH AND ELECTRONIC DEVICE

CROSS-REFERENCE TO RELATED APPLICATIONS

The present application claims priority from Japanese Patent Application No. 2010-187996, filed Aug. 25, 2010. The contents of both priority applications are hereby incorporated by reference in their entirety.

BACKGROUND OF THE INVENTION

1. Technical Field

One or more embodiments of the present invention relate to a switch having a reset function for turning OFF a power supply after a control unit completes data processing when a user stops the use of an electronic device such as a copy machine or a personal computer, and an electronic device.

2. Related Art

Generally, in a switch having a data protecting performance, contacts faced to each other so as to come into contact with and separate from each other in the switch are brought into contact to turn ON the power supply of the switch when the user manually operates an operating element operated in a see-saw manner, for example. The operating element is thereafter automatically inverted by a reset signal output by the control unit to switch to the power supply OFF state. Such a switch with reset function has been proposed (see e.g., Japanese Unexamined Patent Publication No. 3907759).

This type of switch with reset mechanism, however, incorporates a power supply switch mechanism for turning ON/OFF the power supply by bringing into contact with and separating the contacts of a movable piece and a fixed terminal, and a power supply reset mechanism for releasing the ON holding state of the power supply by a solenoid inside a housing.

Specifically, one power supply reset mechanism and two power supply switch mechanisms on both sides thereof are arranged in parallel in the housing. An arrangement space for lining them in parallel in three columns in the housing is thus required, and the dimension in the short side direction (width direction) of the switch becomes greater according to the number of parallels. Furthermore, the arrangement space in the longitudinal direction needs to be long because a long movable piece is arranged inside the housing so as to be turned ON/OFF by being turned in the longitudinal direction of the switch. As a result, there is a limit to miniaturizing the switch in the current situation even if configured to efficiently accommodate the switch components, and further slimming and miniaturization of the switch cannot be achieved.

Although, this type of switch is used in an application of opening and closing a large current as the power supply switch, welding easily occurs at the contact when opening and closing such a large current. Therefore, consideration is made in enhancing the bias force of a spring for returning the movable piece and reliably spacing apart the contacts, but the operation feeling of the switch degrades if the bias force of the spring is enhanced and the abrasion at the switch mechanism section that is subjected to high bias pressure of the spring advances thereby shortening the lifespan.

SUMMARY OF INVENTION

One or more embodiments of the present invention may provide a switch in which the switch components are separately arranged at the portion where the switch components tend to be arranged in a concentrated manner in the housing without being collectively arranged in one region in the housing to achieve miniaturization and slimming, and in which the welding avoiding performance at the contact is enhanced to extend the lifespan, and an electronic device.

In one accordance with one aspect of one or more embodiments of the present invention, a switch include an operating element supported by a housing and oscillation operated to one side and an other side; a power supply switch mechanism for bringing contacts of a movable piece and a fixed terminal facing each other in the housing into contact with each other when the operating element is oscillation operated to one side; a return spring for biasing the operating element in an oscillation operating direction when the operating element is oscillation operated to the other side; and a power supply holding release mechanism configured by a holding portion for holding a contact state of the contacts of the movable piece and the fixed terminal by regulating the return spring in an anti-biasing direction when the operating element is oscillation operated to one side, and a releasing portion for releasing the contact state held by the holding portion; wherein the power supply switch mechanism, the return spring, and the power supply holding release mechanism are arranged in an internal space of the housing; and the power supply holding release mechanism is arranged on the one side in the oscillation operating direction of the operating element and the power supply switch mechanism is arranged on the other side in the oscillation operating direction of the operating element.

According to one or more embodiments of the present invention, the power supply holding release mechanism is arranged on the oscillation operating side when the operating element is oscillated to one side, so that the operating element is directly held by the holding portion of the power supply holding release mechanism when the operating element is oscillation operated to one side. Therefore, a configuration in which the oscillation operation force when the operating element is oscillation operated to one side is directly applied to the holding portion to directly operate the holding portion can be realized. Furthermore, because the power supply switch mechanism and the power supply holding release mechanism are arranged separately to one side and the other side in the oscillation operating direction of the operating element in the housing, an arrangement configuration in which such mechanisms are dispersed without being concentrated at the central part of the housing is achieved. A slim switch in which the width direction of the housing is narrowed thus can be formed.

According to one or more embodiments of the present invention, the return spring, and the holding portion and the releasing portion of the power supply holding release mechanism are stacked; the movable piece of the power supply switch mechanism is arranged to be supported in a freely turning manner in the operating direction of the operating element in a folded shape of being folded in the operating direction of the operating element; and a central part in the operating direction in which the operating element is operated and the movable piece are coupled by an elastic body which is inverted based on the oscillation operation of the operating element.

According to one or more embodiments of the present invention, the planar arrangement space of the power supply holding release mechanism can be reduced because the configuring components of the power supply holding release mechanism are stacked. Furthermore, the movable piece can be arranged folded to, for example, an L-shape or the like on the power supply switch mechanism side. Therefore, the turning region of the movable piece becomes the turning trajectory of substantially the radius length and the occupying space of the movable piece can also be reduced. The movable piece itself thus can be compactly incorporated, whereby miniaturization of the switch can be further achieved.

Further, according to one or more embodiments of the present invention, the power supply switch mechanism includes a displacement supporting portion for slidably moving the movable piece in a direction substantially orthogonal to a direction in which contacts come into contact with and separate from each other at an initial contact when the contact of the movable piece is brought into contact with the contact of the fixed terminal.

According to one or more embodiments of the present invention, when the user pushes the operating element in the oscillation operating direction of one side, the movable piece is slidably moved during such an oscillating operation so that the contact of the movable piece can slidably contact on the contact of the fixed terminal. A wiping operation is thereby obtained with the contacts, the contact configuration in which the welding is avoided in advance is realized, and the operation of a highly reliable switch with improved contact performance can be obtained.

Further, according to one or more embodiments of the present invention, the operating element is configured to include a forced pressurization portion for forcibly pressurizing the movable piece in a direction the contact of the movable piece moves away from the contact of the fixed terminal upon receiving the operation force of the operating element at which the operating element is oscillation operated to the other side.

According to one or more embodiments of the present invention, if the user relatively strongly pushes the operating element in the oscillation operating direction of the other side even if welding supposedly occurred at the contacts, the force in the direction of separating the contacts of the movable piece and the fixed terminal is applied on the movable piece through the forced pressurization portion for the operation force. The welded contacts thus can be reliably separated by applying a separating force on the contacts by the manual operation force.

The switch configured in such a manner can be widely applied in various types of electronic devices including a control unit such as a copy machine or a personal computer as a miniature switch.

According to one or more embodiments of the present invention, there is provided a switch in which the switch components are separately arranged at the portion where the switch components tend to be arranged in a concentrated manner in the housing without being collectively arranged in one region in the housing to achieve miniaturization and slimming, and in which the welding avoiding performance at the contact is enhanced to extend the lifespan, and an electronic device.

DETAILED DESCRIPTION

Hereinafter, embodiments of the present invention will be described with reference to the drawings. In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

Figure 1A:
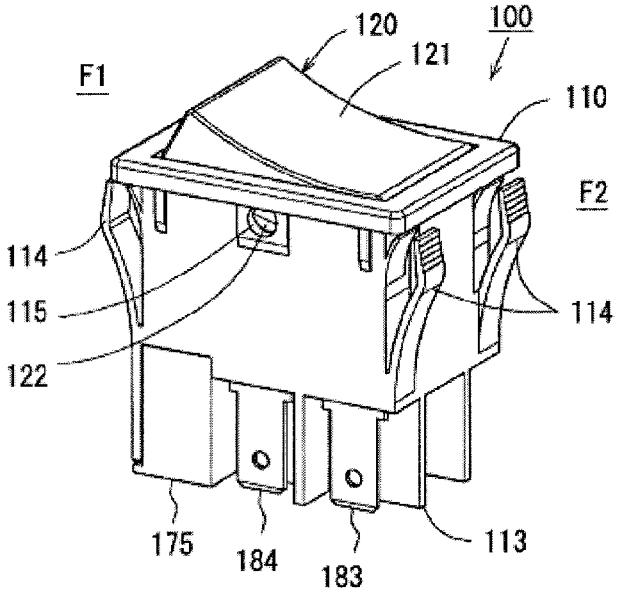
FIGS. 1A and 1B are perspective views of an outer appearance of a switch of a first embodiment.
Figure 1B:
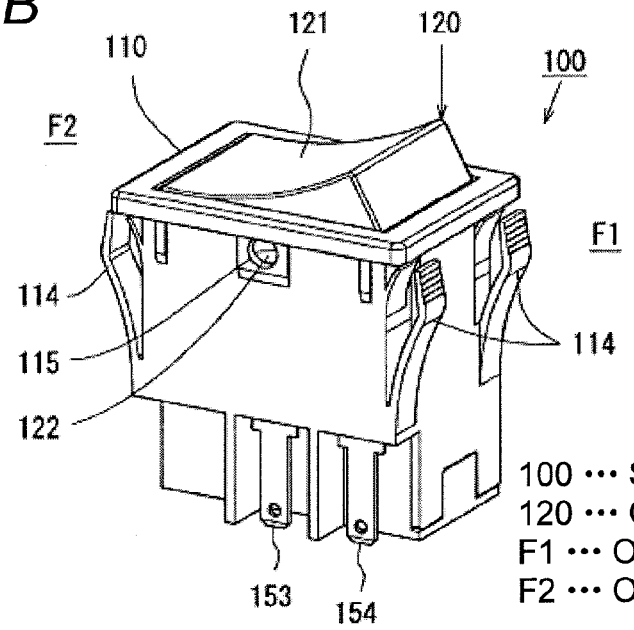
Figure 2:
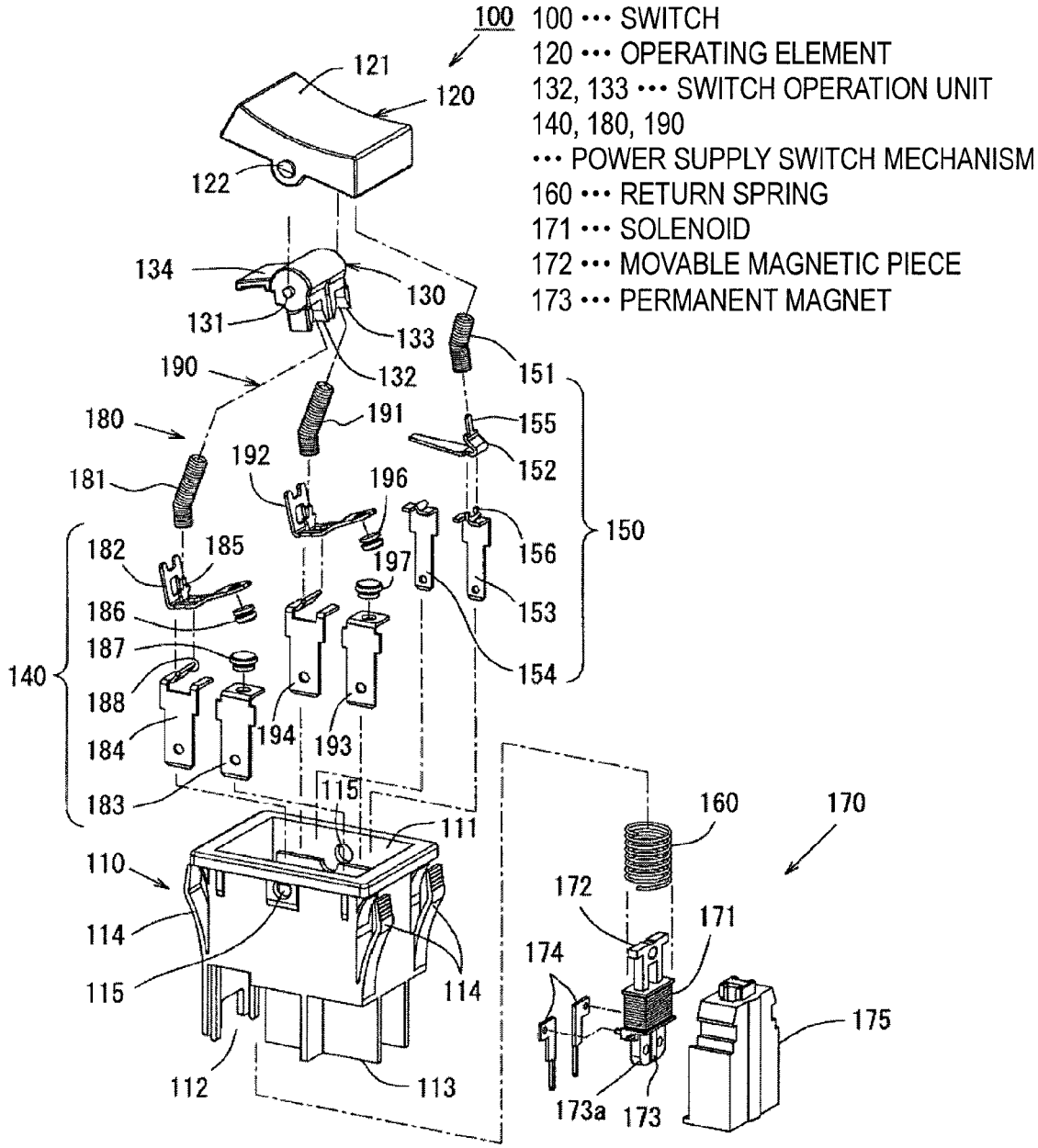
FIG. 2 is an exploded perspective view of the switch of the first embodiment seen from the diagonally upper side.
Figure 3:
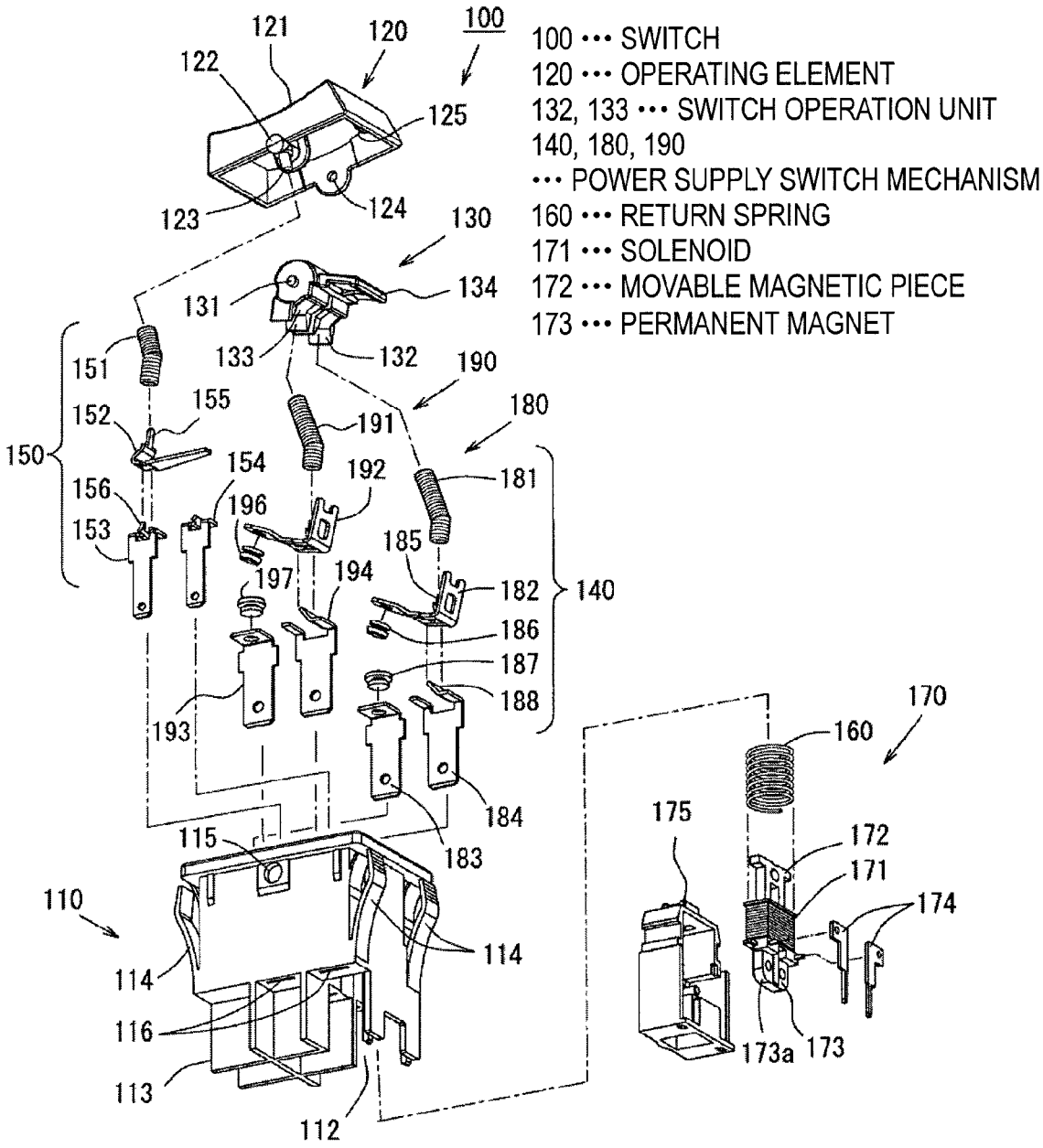
FIG. 3 is an exploded perspective view of the switch of the first embodiment seen from the diagonally lower side.

The drawings show a switch with a reset function, where FIG. 1A shows a perspective view of an outer appearance of a switch 100 seen from one side, and FIG. 1B shows a perspective view of the outer appearance of the switch 100 seen from the other side. FIG. 2 shows an exploded perspective view of the switch 100 seen from a diagonally upper side, and FIG. 3 shows an exploded perspective view of the switch 100 seen from a diagonally lower side.

The switch 100 having the reset function is configured to incorporate an operating element 120, a rotation operating body 130, a power supply switch mechanism 140, a signal switch mechanism 150, a return spring 160, and a power supply reset mechanism 170 in a housing 110.

The housing 110 has a box shape with the upper surface opened, where a recess shaped hollow portion 111 for incorporating the components 130, 140, 150, 160 described above is provided on the upper side, and a bottom attachment portion 112 and a terminal partitioning portion 113 for incorporating the power supply reset mechanism 170 from the lower side are provided on the bottom side. The operating element 120 that planarly closes with respect to the open surface of the hollow portion 111 is turnably attached after incorporating the components to the hollow portion 111 opened on the upper side.

Elastic lock pieces 114 for slip out preventing attachment projected out to fit and attach the switch 100 are arranged on both outer side surfaces having a narrow width of the housing 110. Pivot holes 115 for turnably supporting the operating element 120, to be described later, are arranged at central parts on both sides of the outer side surface having a wide width of the housing 110.

The operating element 120 is provided in a rectangular solid box shape having a bottom surface opened, the upper surface of which being a push operating surface 121 formed into a gradual recessed arcuate surface suited to be pushed with a fingertip. Furthermore, supporting shafts 122 are arranged in a projecting manner at the central parts on both sides of the outer side surface having a wide width of the operating element 120. The supporting shafts 122 are pivotally supported in a freely turning manner at the pivot holes 115 of the housing 110, so that the operating element 120 is turnably attached to the housing 110 in a see-saw manner with the pivot supporting portions on both sides as the supporting points of turn.

Therefore, the operating element 120 is pivotally supported in a freely turnable manner in a see-saw form and oscillated in the housing 110, where one side F1 in the oscillation operating direction is set to the power supply ON side and the other side F2 is set to the power supply OFF side.

Furthermore, as shown in FIG. 3, the operating element 120 has coupling shafts 123 vertically arranged on one side and pivot holes 124 for pivotally supporting both sides of the rotation operation body 130, to be described later, formed on the other side on a line connecting the supporting shafts 122 on both sides in the opened internal space at the bottom surface. Further, a pushing element 125 (see FIGS. 6A to 6F) for pushing down a return spring regulating piece 134, to be described below, is vertically arranged on one side of the internal space.

The rotation operating body 130 described above is arranged as an operation member for ON/OFF operating the power supply, and is configured by a pivot shaft 131, a first switch operating portion 132, a second switch operating portion 133, and a return spring regulating piece 134.

The pivot shaft 131 is pivotally supported in a freely turning manner at the pivot hole 124 formed at the inner surface on both sides of the operating element 120. The rotation operating body 130 is thus arranged to be freely turnable separate from the turning of the operating element 120 in the operating element 120.

That is, when the operating element 120 is turned and ON operated to the one side F1, it is pushed downward by the pushing element 125 thereby receiving the operation force from the operating element 120, and when OFF operated to the other side F2, it is not in contact and does not receive the operation force from the operating element 120.

The first switch operating portion 132 and the second switch operating portion 133 are arranged on both sides at the lower surface connecting the pivot shafts 131 on both sides of the rotation operating body 130. The first switch operating portion 132 fits to and holds the upper part of a first spring coupling body 181 arranged at the upper part of a first power supply switch mechanism 180 to be described later. The second switch operating portion 133 fits to and holds the upper part of a second spring coupling body 191 arranged at the upper part of a second power supply switch mechanism 190.

The rotation operating body 130 includes a return spring regulating piece 134 having a flat plate shape arranged in a projecting manner substantially horizontally, and is configured to push down a movable magnetic piece 172, to be described later, biased upward by the lower surface of the return spring regulating piece 134.

The power supply switch mechanism 140 has a two-series switch configuration arranged in parallel in correspondence with two circuits of the first power supply switch mechanism 180 and the second power supply switch mechanism 190.

The first power supply switch mechanism 180 is configured to include the first spring coupling body 181, a movable piece 182, a fixed terminal 183, and a common fixed terminal 184.

The first spring coupling body 181 uses a thin coil spring. The first spring coupling body 181 is coupled by fitting the upper end in the first switch operating portion 132. The lower end is coupled to the movable piece 182 so as not to slip out by inserting and fitting a fit-in projection 185, which projects out upward, of the movable piece 182 to be described later in a hole of the coil spring. The first spring coupling body 181 is formed into a dogleg shape in which the central part in the axial direction is slightly bent to one side when assembled.

The movable piece 182 is formed by bending a conducive metal plate to an L-shape, and is supported in a turnable manner at the common fixed terminal 184 to be described later with the bent portion of the L-shape as the supporting point of turn. The fit-in projection 185 is raised and formed at the intermediate portion of the movable piece 182 to securely attach a conductive contact 186 at a distal end on the horizontal piece side of the L-shape.

The fixed terminal 183 is formed by bending a conductive metal plate to a reverse L-shape, where the conductive contact 187 is securely attached to the upper surface. The vertical piece side of the reverse L-shape of the fixed terminal 183 is inserted and attached to a terminal attachment hole 116 of the housing 110. In this case, the contact 187 is arranged facing upward on the bottom surface of the housing 110 to face the contact 186 of the movable piece 182 on the upper side.

Similarly, the common fixed terminal 184 is formed by bending a conductive metal plate to a reverse L-shape, where a movable piece supporting portion 188 is raised and formed on the upper surface. The vertical piece side of the reverse L-shape is inserted and attached to the terminal attachment hole 116 of the housing 110.

The first spring coupling body 181 is coupled between the first switch operating portion 132 and the movable piece 182 in the up and down direction in a dogleg shape, where when the rotation operating body 130 forming the first switch operating portion 132 is turned, the direction at the upper part supporting the first spring coupling body 181 differs one from the other on the turning path on the lower side thereby creating an angle difference that displaces so that the switch operation force with respect to the movable piece 182 on the lower side is applied.

Through the use of the first spring coupling body 181, abundant elasticity is achieved, flexible bendability can be obtained not only in the axis direction but also in the cross direction, and an elastic deformation necessary for repeatedly turning ON and OFF such as with the switch can be easily obtained. Therefore, the movable piece 182 on the lower side can be smoothly operated in the ON direction and the OFF direction by easily following the angle difference by using the first spring coupling body 181 excelling in flexibility that can follow the turning of the rotation operation body 130.

The second power supply switch mechanism 190 has the same configuration as the first power supply switch mechanism 180. Furthermore, a parallel arrangement configuration in which the first power supply switch mechanism 180 and the second power supply switch mechanism 190 simultaneously receive the operation force of one operating element 120 is adopted. Thus, the second power supply switch mechanism 190 executes the same function as the first power supply switch mechanism 180. As the components same as each component of the first power supply switch mechanism 180 can be arranged, the description of the second power supply switch mechanism 190 including the first spring coupling body 191, the movable piece 192, the fixed terminal 193, the common fixed terminal 194, and each contact 196, 197 is already made with the first power supply switch mechanism 180 and hence will not be repeated.

The signal switch mechanism 150 is configured by a third spring coupling body 151, a signal moveable piece 152, a signal common fixed terminal 153, and a signal fixed terminal 154.

The third spring coupling body 151 is configured similar to the first spring coupling body 181 described above, and uses a thin coil spring. The third spring coupling body 151 is coupled to the signal movable piece 152 by fitting and coupling the spring hole at the upper end to the coupling shaft 123 vertically arranged at the lower surface of the operating element 120, and fitting the spring hole at the lower end to the fit-in projection 155 projecting upward at the upper end of the signal movable piece 152 to be described later. In this case as well, the third spring coupling body 151 is formed into a dogleg shape in which the central part in the axial direction is slightly bent to one side when assembled.

The signal movable piece 152 is formed by bending the conductive metal plate to an L-shape, and is supported in a turnable manner at the signal common fixed terminal 153 to be described later with the bent portion of the L-shape as the supporting point of turn. The fit-in projection 155 described above is arranged at the intermediate portion of the signal movable piece 152, and the distal end of the horizontal piece side of the L shape becomes the contact. The configuration of the signal switch mechanism 150 does not require a large contact different from the power supply switch mechanism 130 because a very weak current for signal is flowed.

The signal common fixed terminal 153 is formed by bending a conductive metal plate to a reverse L-shape, where the movable piece supporting portion 156 is raised and formed on the upper surface, and is inserted and attached to a terminal attachment hole 117 of the housing 110.

Similarly, the signal fixed terminal 154 is formed by bending a conductive metal plate to a reverse L-shape, where the upper surface becomes the contact, and is inserted and attached to the terminal attachment hole 117 of the housing 110.

Figure 4:
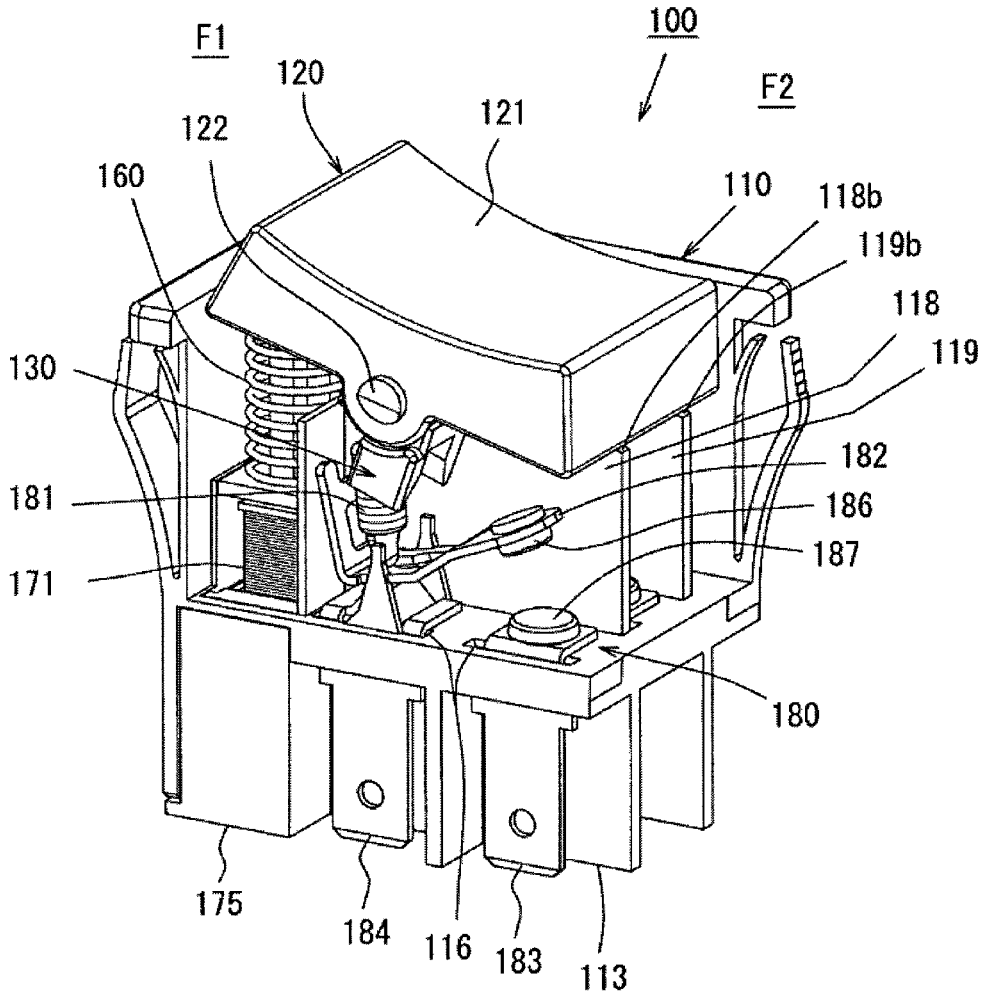
FIG. 4 is a perspective view of the main parts showing a power supply switch mechanism of the first embodiment.

As shown in FIG. 4, the first power supply switch mechanism 180 and the second power supply switch mechanism 190 are partitioned by a first partition plate 118 in the housing 110. As shown in FIG. 4, the second power supply switch mechanism 190 and the signal switch mechanism 150 are partitioned by a second partition plate 119 in the housing 110. The respective switch mechanisms 180, 190, 150 ensure one sectionalized switch operation space by the inner walls of the housing 110 and the respective partition plates 118, 119.

The partition plates 118, 119 have the upper surface configured as stopper surfaces for regulating the turn of the operating element 120 to the one side F1 and the other side F2. An ON stopper surface 118*a* for regulating the ON turn is formed in an inclined manner on the upper surface of the first partition plate 118 facing the one side F1 of the operating element 120, and an OFF stopper surface 118*b* for regulating the OFF turn is formed in an inclined manner on the upper surface of the first partition plate 118 facing the other side F2 of the operating element 120.

Similarly, an OFF stopper surface 119*a* for regulating the OFF turn is formed in an inclined manner on the upper surface of the second partition plate 119 facing the one side F1 of the operating element 120, and an ON stopper surface 119*b* for regulating the ON turn is formed in an inclined manner on the upper surface of the second partition plate 119 facing the other side F2 of the operating element 120.

Figures 6A, 6B, 6C, 6D, 6E, 6F:
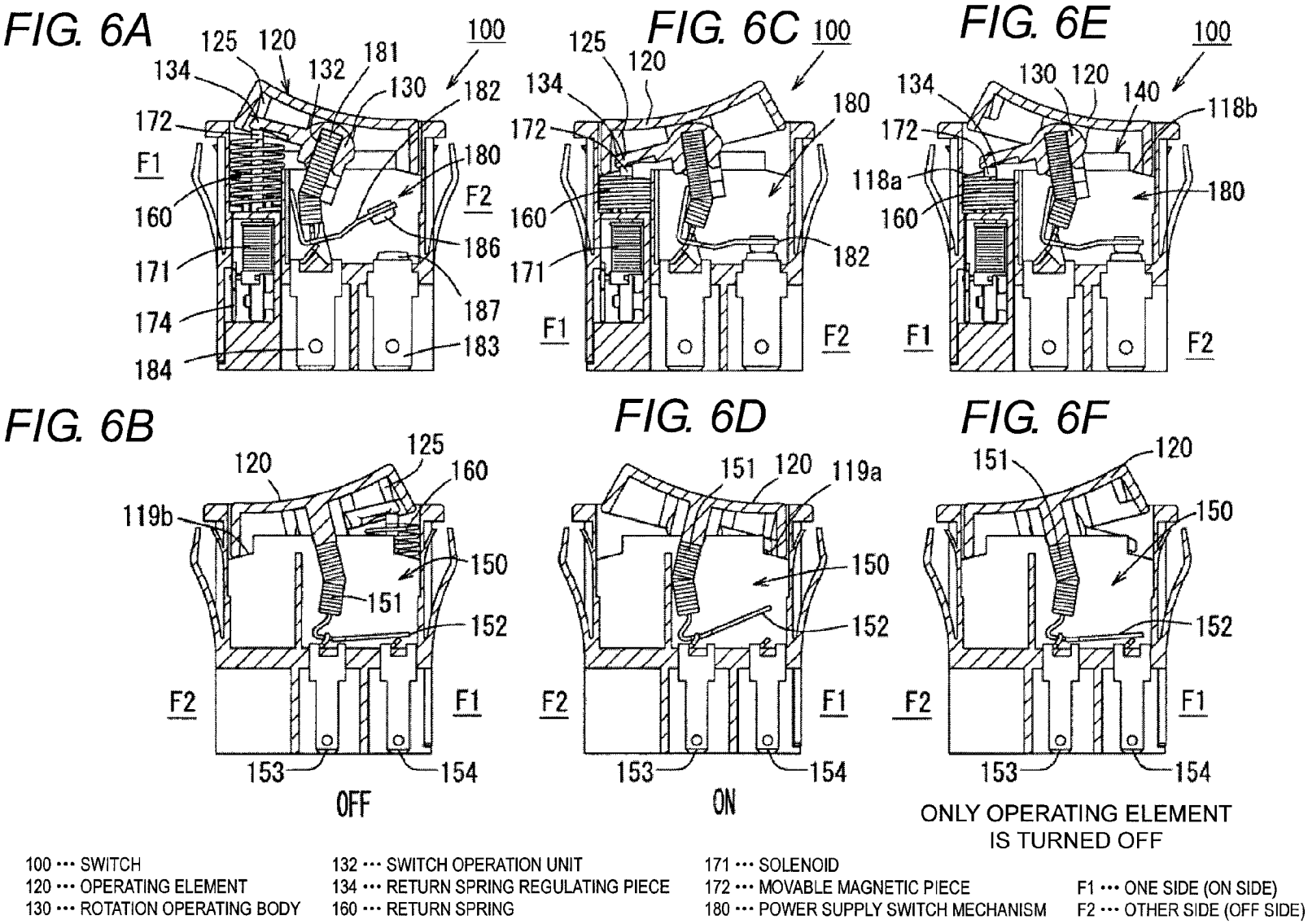
FIGS. 6A to 6F are longitudinal cross-sectional views showing the ON/OFF operation state of the switch of the first embodiment.

The return spring 160 is configured by a coil spring. As shown in FIG. 6A, the return spring 160 is normally extended to push up the rotation operating body 130 and the operating element 120 and turned in the OFF direction.

The power supply reset mechanism 170 is configured to include a solenoid 171, a movable magnetic piece 172, a permanent magnet 173, a fixed magnetic piece (yoke) 173*a*, a reset signal input terminal 174, and a solenoid case 175.

The solenoid 171 wound coil includes an inserting portion opened in the up and down direction at the interior so that the movable magnetic piece 172, to be described later, can be inserted to the inserting portion in the up and down direction. Furthermore, the permanent magnet 173, the fixed magnetic piece 173*a*, and the reset signal input terminal 174 are arranged on the inner end side of the inserted movable magnetic piece 172.

The movable magnetic piece 172 has a T-shape, where the lower side of the T-shaped portion is arranged to be freely insertable to the inserting portion of the solenoid 171 in two parallel columns, and the return spring 160 is interposed in a state compressed in the up and down direction between the T-shaped portion of the movable magnetic piece 172 and the coil side upper end face of the solenoid 171, as shown in FIGS. 6A to 6F.

When receiving the downward pushing force, the movable magnetic piece 172 moves downward against the biasing force of the return spring 160 and is inserted to the lower end, whereby the movable magnetic piece 172 is adsorbed and held by the rectangular solid permanent magnet 173 opposing at the lower side and the U-shaped fixed magnetic piece 173*a* arranged on both sides with the permanent magnet 173 in between. The power supply ON state is held by such adsorbing and holding action. When the magnetism release action is applied on the solenoid 171 in the power supply ON state, the adsorption is released thereby turning OFF the power supply.

In FIGS. 6A to 6F, FIGS. 6A, 6C, and 6E at the upper level show the ON/OFF operation state of the first power supply switch mechanism 180 when the switch 100 is seen from one side surface, and FIGS. 6B, 6D, and 6F at the lower level show the ON/OFF operation state of the signal switch mechanism 150 when the switch 100 is seen from the other side surface. FIGS. 6A and 6B arranged at the left side show the OFF state, FIGS. 6C and 6D arranged at the middle show the ON state, and FIGS. 6E and 6F arranged at the right side show the state in which the only the operating element is turned OFF.

As shown in FIG. 4 and FIG. 6A, normally in the first power supply switch mechanism 180, the return spring 160 is extended in the power supply switch OFF state, so that the upper end of the movable magnetic piece 172 biased by the return spring 160 pushes up the return spring regulating piece 134 and also pushes up the operating element 120 through the pushing element 125 to bias and support at the OFF position. In this case, the rotation operating body 130 is in a state rotated in the OFF direction. In the OFF state, the power supply OFF state in which the first spring coupling body 181 is bent to an arch shape, the movable piece 182 is turned in the OFF direction, and the contact 186 of the movable piece 182 is spaced apart from the contact 187 of the fixed terminal 183 is achieved.

Figure 5:
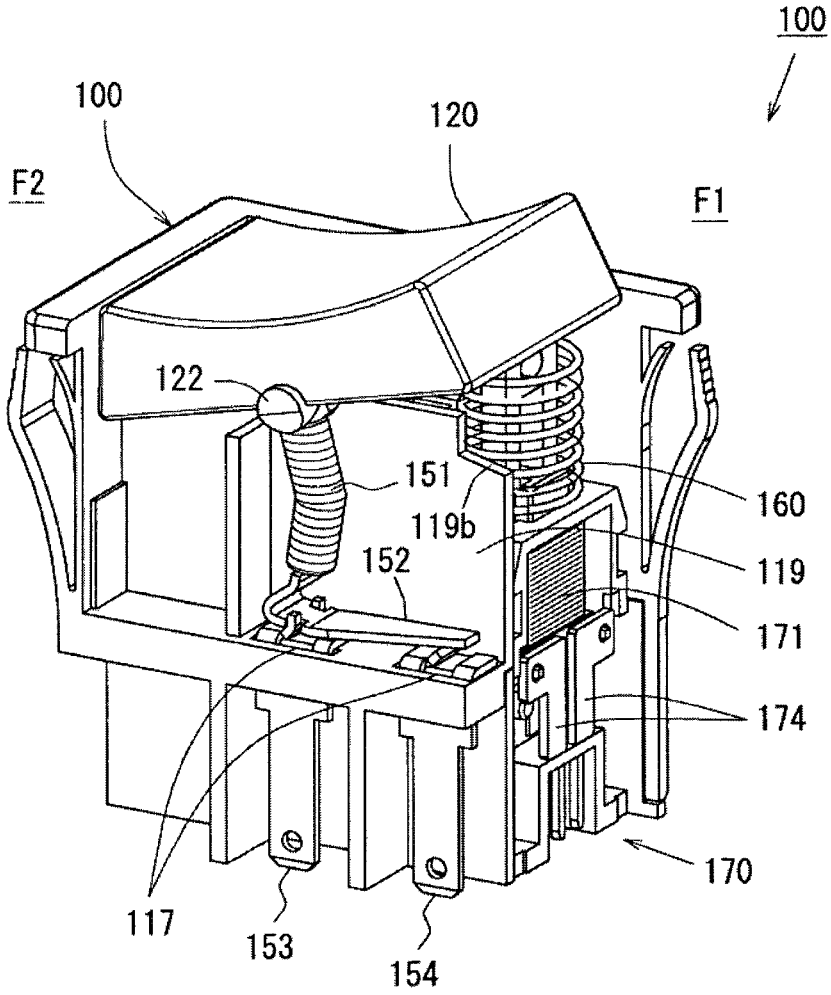
FIG. 5 is a perspective view of the main parts showing a signal switch mechanism of the first embodiment.

As shown in FIG. 5 and FIG. 6B, in the signal switch mechanism 150, the third spring coupling body 151 is bent to an arch shape in a direction opposite to the first spring coupling body 181 so that the signal movable piece 152 is brought into contact with the signal fixed terminal 154 when the operating element 120 is at the OFF position. The conductive state in which the signal movable piece 152 and the signal fixed terminal 154 are brought into contact is set to OFF and the separated state is set to ON in the signal switch mechanism 150.

As shown in FIG. 6C, when the switch 100 configured as above is ON operated, the pushing element 125 of the operating element 120 pushes down the return spring regulating piece 134 and further pushes down the movable magnetic piece 172 against the biasing force of the return spring 160 when the operating element 120 is pushed in the ON direction. The movable magnetic piece 172 thereby moves downward and is inserted into the operation unit of the solenoid 171, and receives the magnetic attracting action of the permanent magnet 173 facing thereto on the lower side to be adsorbed. In this case, the return spring 160 is compressed and thus is held in the compressed state. The axially central part of the first spring coupling body 181 of the first power supply switch mechanism 180 reflexes in the opposite direction when the operating element 120 is ON operated, whereby the movable piece 182 is turned by the reactive force thus bringing the contacts 186, 187 into contact and turning ON the power supply.

The power supply reset mechanism 170 is arranged on the ON side that is one side F1 in the oscillation operating direction of the operating element 120 in the housing 110. The first power supply switch mechanism 180 is arranged on the OFF side that is the other side F2 in the oscillation operating direction of the operating element 120. Thus, when the operating element 120 is operated to the ON side, the magnetic piece 172 is adsorbed and held by the solenoid 171 of the power supply reset mechanism 170 in the operating direction of the operating element 120, and then locked. The ON operation force of the operating element 120 is thus directly applied to the power supply reset mechanism 170.

Because the first power supply switch mechanism 180 and the power supply reset mechanism 170 can be arranged separately on the ON side and the OFF side of the operating element 120, that is, the one side F1 and the other side F2 in the oscillation operating direction of the operating element 120 in the housing 110, an arrangement configuration in which such mechanisms are dispersed without being concentrated at the central part of the housing 110 can be realized. A slim switch 100 in which the width direction of the housing 110 is narrowed can be configured.

The second power supply switch mechanism 190 moves in the same way as the movement of the first power supply switch mechanism 180, and is ON operated in synchronization.

The signal switch mechanism 150 is turned ON at substantially the same time as the first power supply switch mechanism 180 and the second power supply switch mechanism 190. As shown in FIG. 6D, the signal switch mechanism 150 has the third spring coupling body 151 refluxed to an arch shape in the direction opposite to the first spring coupling body 181 with the turning of the operating element 120 in the ON direction thereby separating the signal movable piece 152 and the signal fixed terminal 154 and turning ON the signal switch mechanism 150.

As shown in FIG. 6E, the operating element 120 is push operated in the OFF direction when turning OFF the switch 100. In this case, the operating element 120 is turned in the OFF direction, but only the operating element 120 is turned, that is, spun around because the biasing force of the return spring 160 is not received on the first power supply switch mechanism 180 side.

Therefore, the rotation operating body 130 does not turn, the return spring regulating piece 134 integrated with the rotation operating body 130 maintains a state where the movable magnetic piece 172 is pushed down, and the power supply switch mechanism 140 is held in the ON state until the reset signal is inputted from the control unit.

As shown in FIG. 6F, the third spring coupling body 151 is refluxed and inverted to an arch shape with the turning of the operating element 120 in the OFF direction on the signal switch mechanism 150 side, where the signal movable piece 152 is turned therewith to again come into contact with the signal fixed terminal 154. Thus, the signal switch mechanism 150 is ON/OFF operated with the movement of the operating element 120.

When the signal switch mechanism 150 is turned OFF, the reset signal from the control unit (not shown) receiving the OFF signal is waited. The first power supply switch mechanism 180 shown in FIG. 6E again returns from the ON state to the original power supply OFF state shown in FIG. 6A at the time point the storage process of the control data to be stored by the hard disk is completed.

Figure 7:
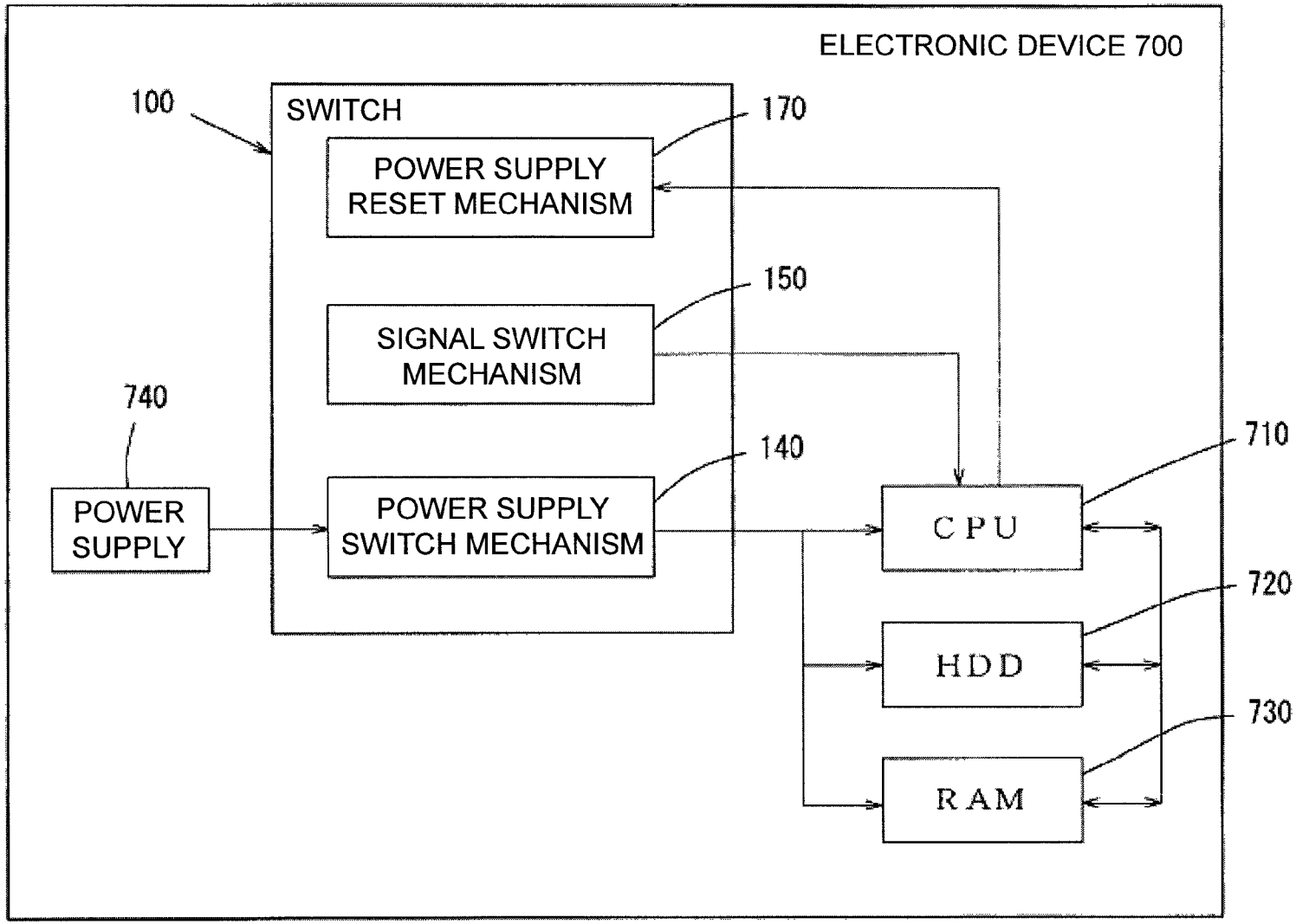
FIG. 7 is a control block diagram showing a data processing state in the electronic device of the first embodiment.

The data processing operation of an electronic device 700 including the switch 100 will now be described with reference to a control block diagram of FIG. 7.

The electronic device 700 has the switch 100 arranged at the ON/OFF operable position, and interiorly includes a CPU 710, a HDD (hard disk) 720, and a RAM 730.

When the operating element 120 of the switch 100 is ON operated, the rotation operating body 130 is turned in the ON direction in response to the operation force, so that the power supply switch mechanism 140 brings the contacts 186, 187, 196, 197 into contact based thereon to turn ON the switch 100 and turn ON the power supply 740 of the electronic device 700. In a state the electronic device 700 is operated in such manner, the CPU 710 stores the processing data of the electronic device 700 in the RAM 730.

When the user operates the operating element 120 of the switch 100 in the OFF direction to stop the use of the electronic device 700, an usage OFF signal is inputted from the signal switch mechanism 150 of the switch 100 to the CPU 710. The CPU 710 holds the power supply ON state until the data processing is completed on the basis thereof, and the power supply OFF signal is not outputted to the power supply reset mechanism 170. In this case, the power supply is in the ON state, and the CPU 710 first reads out the data stored in the RAM 730 and transfers all such data to the HDD 720 for storing.

After the transfer of the data to the HDD 720 is completed, the CPU 710 prioritizes the protection of data and outputs the power supply OFF signal to the power supply reset mechanism 170 of the switch 100 when ensured. On the basis thereof, the electromagnetic release force greater than the magnetic force of the permanent magnet 173 is applied to the solenoid 171 in the switch 100, so that the solenoid 171 releases the regulation of the movable magnetic piece 172 adsorbed to the permanent magnet 173 and the fixed magnetic piece 173*a* so that the movable magnetic piece 172 is in a free state, whereby the movable magnetic piece 172 pushes up the rotation operating body 130 in response to the biasing force at which the return spring 160 extends thereby turning the operating element 120 to the OFF position and separating the contacts 186, 187, 196, 197 of the power supply switch mechanism 140. The power supply is then turned OFF. The CPU 710 thus automatically turns OFF the power supply when completion of data processing is confirmed after the operating element 120 is OFF operated.

Figure 8:
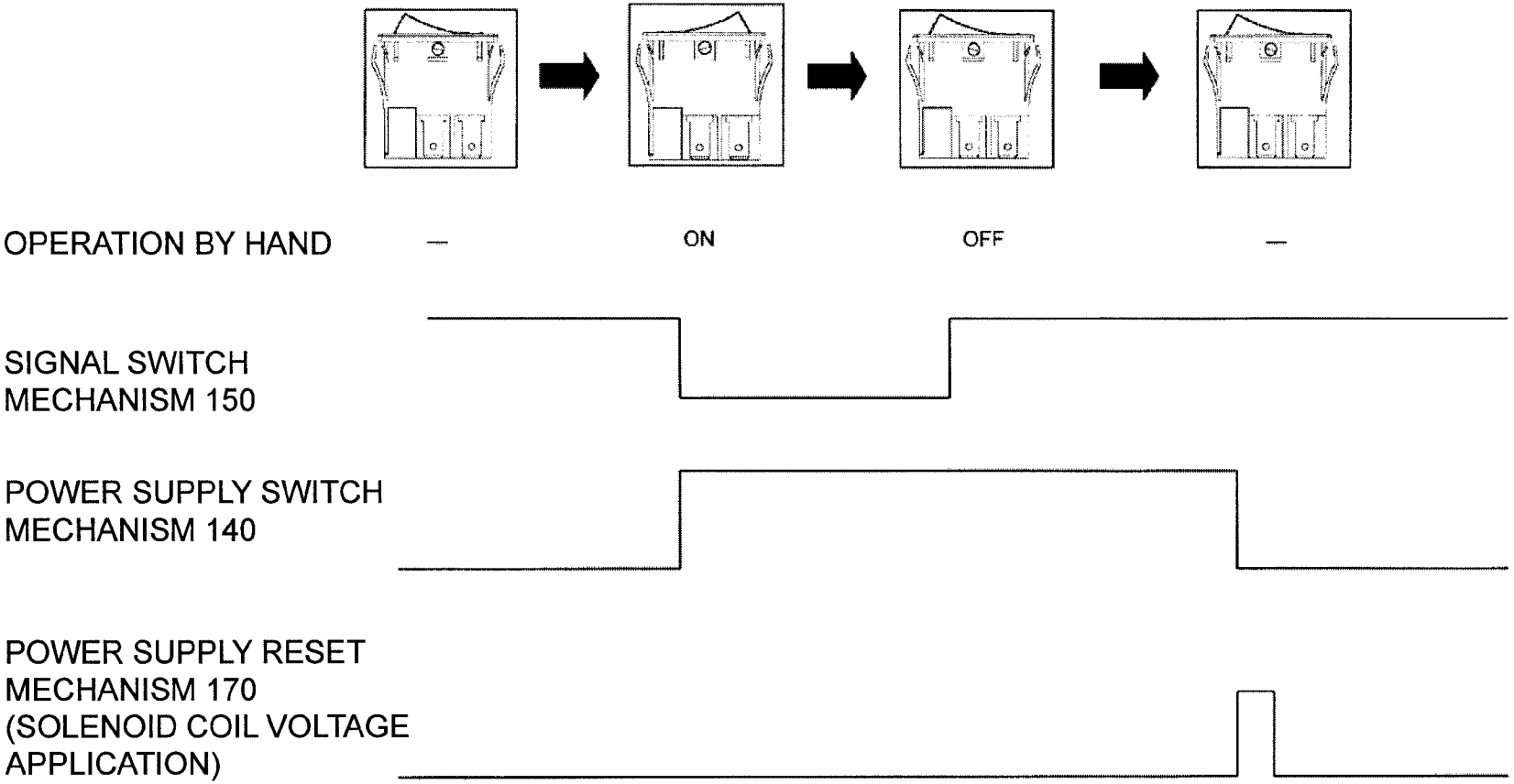
FIG. 8 is a time chart showing the ON/OFF operation state of the switch of the first embodiment.

The reset operation of the switch 100 will be described with reference to the time chart of FIG. 8.

In a standby state in which the user is not operating the operating element 120, the signal switch mechanism 150 flows a very weak current and outputs the OFF signal. The first power supply switch mechanism 180 and the second power supply switch mechanism 190 of the power supply switch mechanism 140, on the other hand, maintain an OFF state without current flow.

When the user ON operates the operating element 120 thereafter, the signal switch mechanism 150 is turned ON when the contacts are separated and the no-current flow is detected, whereas the power supply switch mechanism 140 is in the power supply ON state when the contacts are brought into contact thus flowing current. As the state is the ON state, the solenoid 171 of the power supply reset mechanism 170 maintains the ON state until a reset signal is inputted from a control unit of the electronic device 700 such as a copy machine or a personal computer where the switch 100 is provided.

When the user OFF operates the operating element 120 of the switch 100 with the stopping of the usage of the electronic device 700 after the switch 100 is turned ON and the electronic device is used, the signal switch mechanism 150 is turned OFF at the relevant time point and the OFF signal is outputted. When such OFF output is detected by the control unit (CPU) 710 of the electronic device 700, the write of storing the processing data up to the relevant point in the hard disk is executed.

After the write is completed, the reset signal is outputted from the control unit, and the electromagnetic release force greater than the adsorption force of the permanent magnet 173 is applied to the solenoid 171. The return spring 160 extends based on such release, and the release operation with respect to the power supply switch mechanism 140 is carried out based on the extended biasing force. The rotation operating body 130 and the operating element 120 return to the original OFF position in cooperation thereto.

As described above, the power supply switch mechanism is turned ON when the operating element is ON operated. Thereafter, the power supply is OFF operated, but the power supply switch mechanism maintains the ON state until the power supply reset signal is input even if the power supply if OFF operated, and thus is not immediately turned OFF. The necessary data is written to the hard disc in the meantime, and the power supply is automatically turned OFF when the data processing is completed.

The operating element spins around once the operating element is OFF operated because the biasing force of the return spring is regulated so that the biasing force of the return spring is not applied on the operating element. Therefore, even if the operating element is again ON/OFF operated after the OFF operation, such re-ON/OFF operation force go around in circles and is not transmitted to the contact of the power supply switch mechanism. Therefore, issues may not arise after the operating element is first OFF operated even if the operating element is thereafter again ON/OFF operated carelessly. Furthermore, highly reliable data management can be carried out when such a switch is used in the electronic device.

In the internal configuration of the switch, the power supply switch mechanism 140 and the signal switch mechanism 150, and the power supply reset mechanism 170 are separated in the operating direction of one side F1 and the other side F2 in the housing 110, and hence an arrangement configuration in which such mechanisms are dispersed without being concentrated at the central part of the housing 110 can be realized. A slim switch in which the width direction of the housing is narrowed can be formed.

The switch components are easily arranged, not in parallel, inside the housing 110 because the configuring elements are stacked on the power supply reset mechanism 170 side, whereby a compact arrangement configuration with a small operation area of the switch can be achieved. The switch is thus reliably miniaturized.

Furthermore, because the movable pieces 182, 192 are arranged bent to an L shape and the like on the power supply switch mechanism 140 or the signal switch mechanism 150 side, the turning region of the movable pieces 182, 192 becomes the turning trajectory of substantially the radius length compared to the linear movable piece, and the turning occupying space of the movable piece also becomes smaller. Therefore, the movable piece itself can be compactly incorporated in the housing, whereby the housing 110 can be reduced and the switch can be further miniaturized.

Second Embodiment

Figure 9A:
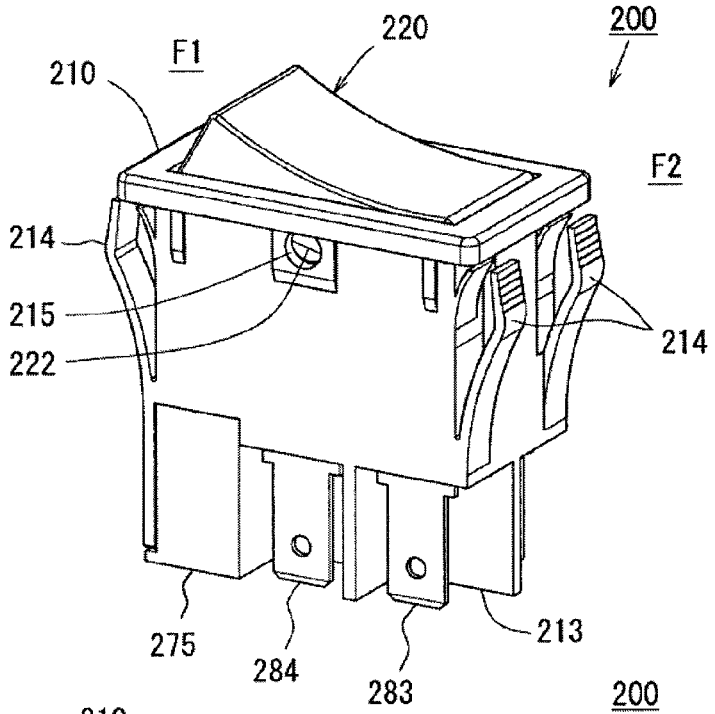
FIGS. 9A and 9B are perspective views of an outer appearance of a switch of a second embodiment.
Figure 9B:
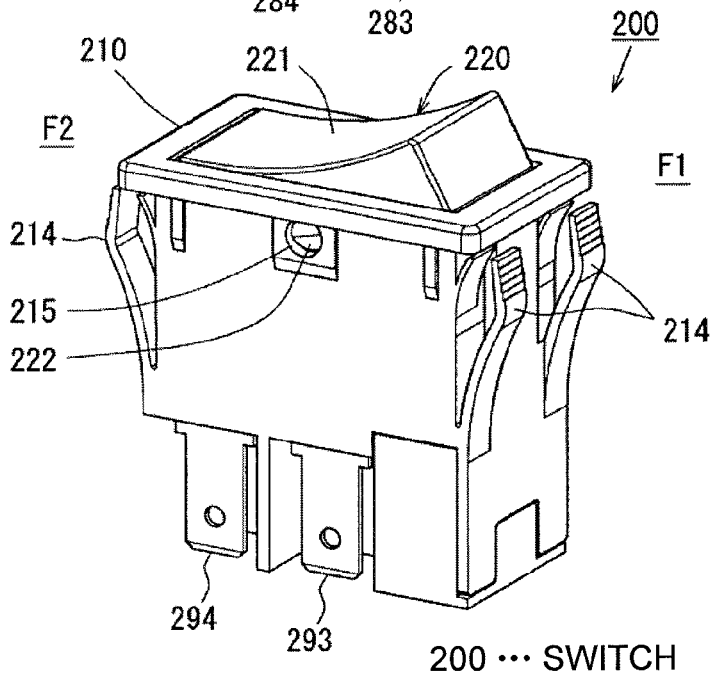
Figure 10:
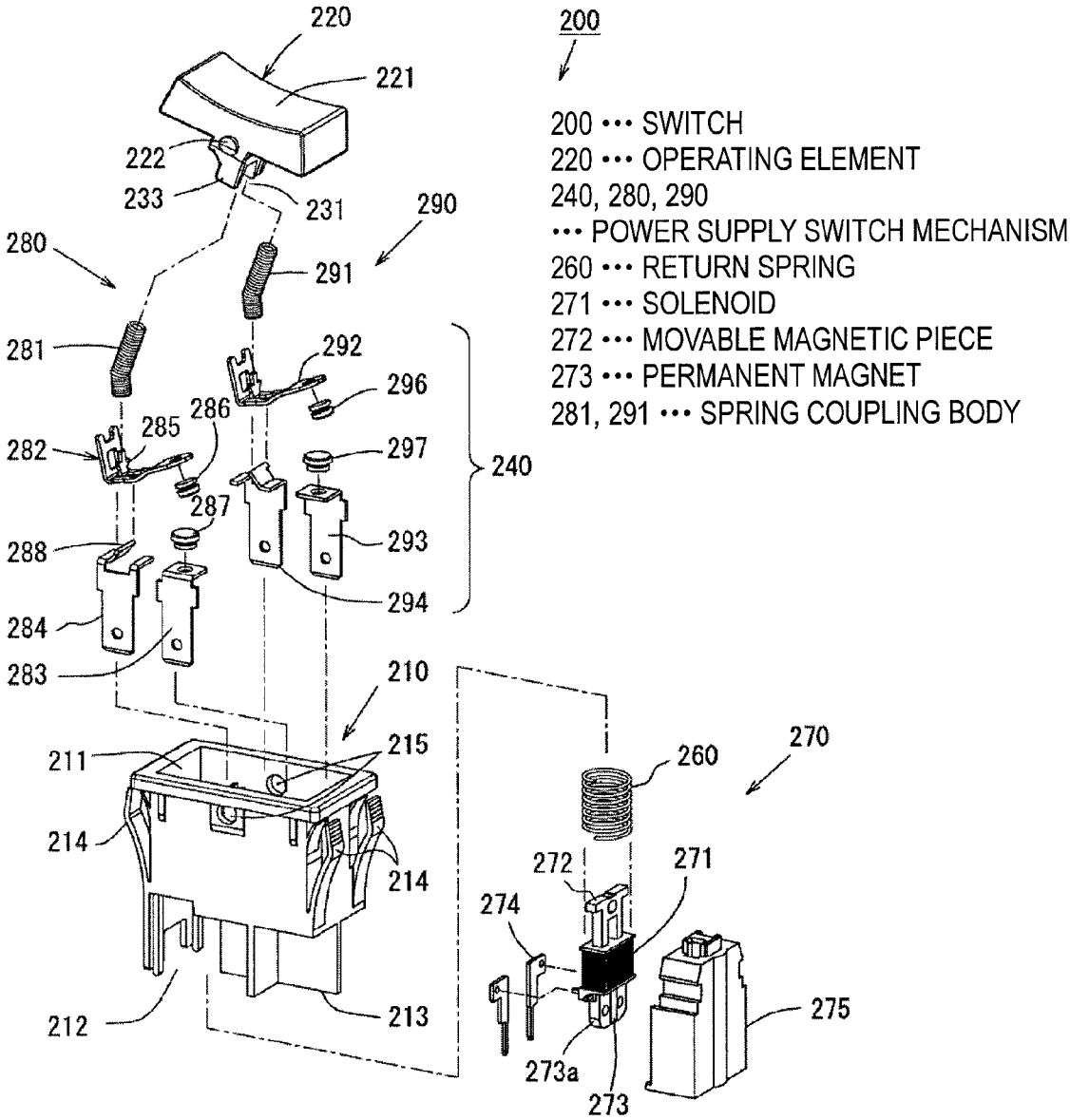
FIG. 10 is an exploded perspective view of the switch of the second embodiment seen from the diagonally front side.
Figure 11:
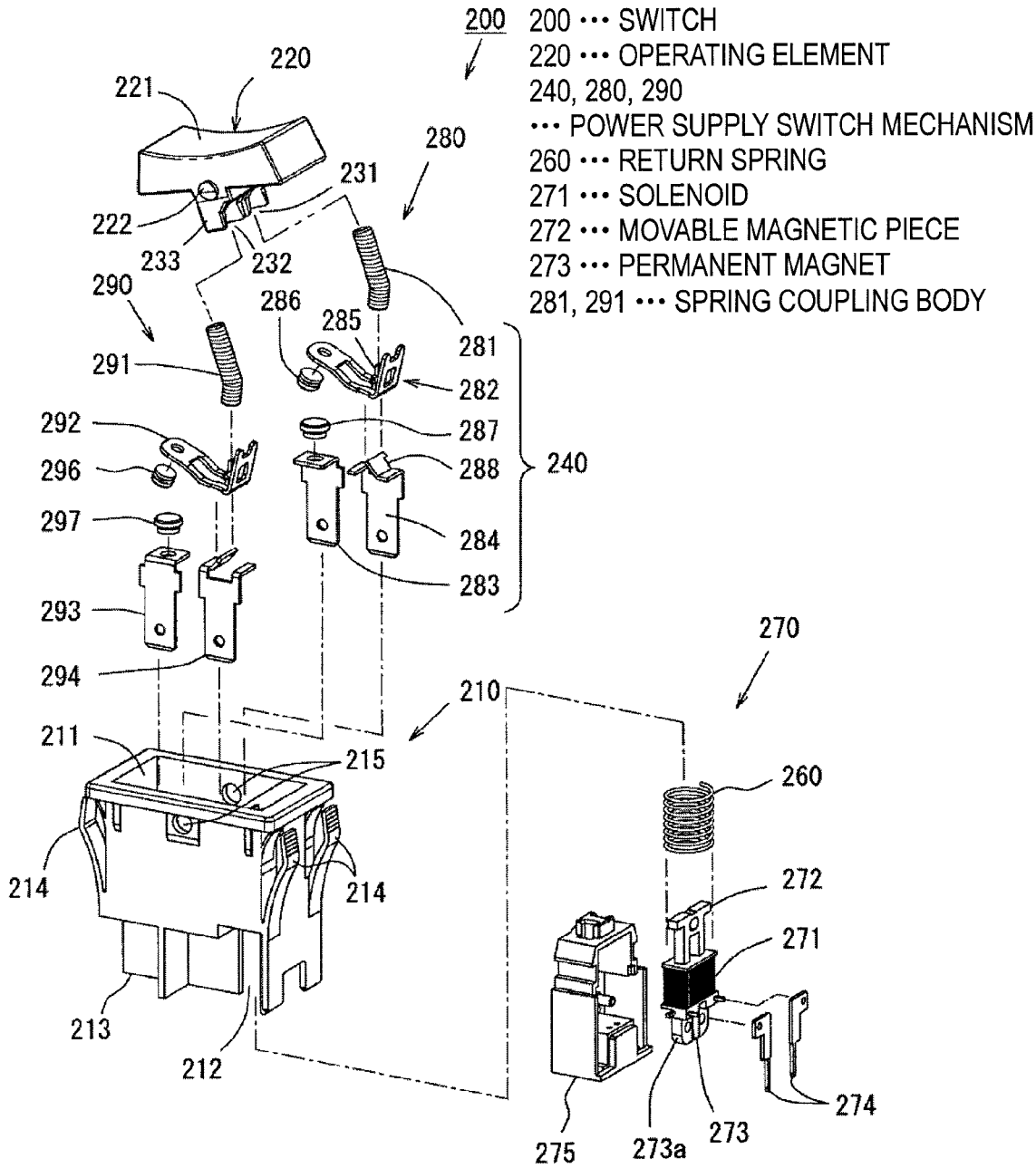
FIG. 11 is an exploded perspective view of the switch of the second embodiment seen from the diagonally back side.

The figures show a switch with a reset function. FIG. 9A shows a perspective view of an outer appearance of a switch 200 seen from one side, and FIG. 9B shows a perspective view of an outer appearance of the switch 200 seen from the other side. FIG. 10 shows an exploded perspective view of the switch 200 seen from one side, and FIG. 11 shows an exploded perspective view of the switch 200 seen from the other side.

The switch 200 with the reset function is configured to incorporate an operating element 220, a power supply switch mechanism 240, a return spring 260, and a power supply reset mechanism 270 in a housing 210.

The housing 210 has a box shape with the upper surface opened, where a recess shaped hollow portion 211 for incorporating the configuring components 240, 260 described above is provided on the upper side, and a bottom attachment portion 212 and a terminal partitioning portion 213 for incorporating the power supply reset mechanism 270 from the lower side are provided on the bottom side. The operating element 220 that planarly closes with respect to the open surface of the hollow portion 211 is attached in a freely turning manner after incorporating the components to the hollow portion 211 opened on the upper side.

An elastic lock piece 214 for slip out preventing attachment projected to fit and attach the switch 200 is arranged on both outer side surfaces having a narrow width of the housing 210. A pivot hole 215 for supporting the operating element 220, to be described later, in a turnable manner is arranged at a central part on both sides of the outer side surface having a wide width of the housing 210.

The operating element 220 is provided in a rectangular solid box shape having a bottom surface opened, the upper surface of which being a push operating surface 221 formed into a gradual recessed arcuate surface suited to be pushed with a fingertip. Furthermore, supporting shaft 222 are arranged in a projecting manner at the central parts on both sides of the outer side surface having a wide width of the operating element 220. The supporting shafts 222 are pivotally supported in a freely turning manner at the pivot holes 215 of the housing 210, and the operating element 220 is turnably attached to the housing 210 in a see-saw manner with the pivot supporting portions on both sides as the supporting points of turn.

The operating element 220 is vertically arranged with the pushing element 225 (see FIGS. 13A and 13B) that projects out downward at one side of the internal space with the opened bottom surface. The upper surface of the movable magnetic piece 272, to be described later, biased upward is pushed downward with the lower end of the pushing element 225.

Furthermore, the operating element 220 is arranged as an operation member for ON/OFF operating the power supply by being turned, where a first switch operation unit 231, a second switch operation unit 232, and a forced pressurization piece 233 are arranged at the lower surface of the operating element 220.

The first switch operation unit 231 and the second switch operation unit 232 are arranged on both sides of the lower surface connecting the supporting shafts 222 on both sides of the operating element 220. The first switch operation unit 231 includes a circular hole, to which the upper part of the first spring coupling body 281 arranged at the upper part of the first power supply switch mechanism 280 is fitted and held. The second switch operation unit 232 includes a circular hole, to which the upper part of the second spring coupling body 291 arranged at the upper part of the second power supply switch mechanism 290 is fitted and held.

The forced pressurization piece 233 is the vertically arranged portion where the side walls on both sides of the first switch operation unit 231 and the second switch operation unit 232 are vertically arranged as vertically long rectangular plate. Such a forced pressurization piece 233 is vertically arranged as one part of the operating element 220 on both sides at the central part of the lower surface of the operating element 220. Therefore, the forced pressurization piece 233 integrally turns with the operating element 220. As will be hereinafter described in FIGS. 15A to 15C, the operation force of the operating element 220, where the operating element 220 is OFF operated, is received by the movable pieces 282, 292. The contacts 286, 296 of the movable pieces 282, 292 are forcibly pressurized in the direction of separating from the contacts 287, 297 of the fixed terminals 283, 293.

The power supply switch mechanism 240 has a two-series switch configuration of being arranged in parallel in correspondence with two circuits, the first power supply switch mechanism 280 and the second power supply switch mechanism 290.

The first power supply switch mechanism 280 includes a first spring coupling body 281, a movable piece 282, a fixed terminal 283, and a common fixed terminal 284.

The first spring coupling body 281 uses a thin coil spring. The first spring coupling body 281 is coupled by fitting the upper end in the first switch operation unit 231. The lower end is coupled to the movable piece 282 so as not to slip out by inserting and fitting a fit-in projection 285, which projects out upward, of the movable piece 282 into the hole of the coil spring. The first spring coupling body 281 has a dogleg shape in which the central part in the axial direction is slightly bent to one side when assembled.

The movable piece 282 is formed by bending a conductive metal plate to an L-shape, and is supported in a turnable manner at the common fixed terminal 284, to be described later, with the bent portion of the L-shape as the supporting point of turn. The fit-in projection 285 is raised and formed at the intermediate portion of the movable piece 282 to securely attach the conductive contact 286 at the distal end on the horizontal piece side of the L-shape.

The fixed terminal 283 is formed by bending a conductive metal plate to a reverse L-shape, where the conductive contact 287 is securely attached to the upper surface. The vertical piece side of the reverse L-shape of the fixed terminal 283 is inserted and attached to a terminal attachment hole 216 of the housing 210. In this case, the contact 287 is arranged facing upward on the bottom surface of the housing 210 so as to face the contact 286 of the movable piece 282 on the upper side.

Similarly, the common fixed terminal 284 is formed by bending a conductive metal plate to a reverse L-shape, where a movable piece supporting portion 288 is raised and formed on the upper surface. The vertical piece side of the reverse L-shape is inserted and attached to the terminal attachment hole 216 of the housing 210.

The first spring coupling body 281 is coupled between the top and bottom of the first switch operation unit 231 and the movable piece 282 in a dogleg shape, where when the operating element 220 forming the first switch operation unit 231 is turned, the direction at the upper part supporting the first spring coupling body 281 differs one from the other on the turning trajectory on the lower side thereby creating an angle difference so that the intermediate portion of the first spring coupling body 281 is inverted and the switch operation force with respect to the movable piece 282 on the lower side is applied.

Through the use of the first spring coupling body 281, abundant elasticity is achieved, flexible bendability can be obtained not only in the axis direction but also in the cross direction, and an elastic deformation necessary for repeatedly turning ON and OFF such as with the switch can be easily obtained. Therefore, the movable piece 282 on the lower side can be smoothly turned in the ON direction and the OFF direction by easily following the angle difference by using the first spring coupling body 281 excelling in flexibility that can follow the turning of the operating element 220.

Furthermore, the power supply reset mechanism 270 is arranged on the ON side that is one side F1 in the oscillation operating direction of the operating element 220 in the housing 210. The first power supply switch mechanism 280 is arranged on the OFF side that is the other side F2 in the oscillation operating direction of the operating element 220. Therefore, when the operating element 220 is operated to the ON side, the magnetic piece 272 is adsorbed and held, and locked at the solenoid 271 of the power supply reset mechanism 270 in the operating direction of the operating element 220. The ON operation force of the operating element 220 thus directly applies on the power supply reset mechanism 270, and a configuration in which the relay member for transmitting the operation force is not described can be adopted.

Because the first power supply switch mechanism 280 and the power supply reset mechanism 270 can be arranged separately to the ON side and the OFF side of the operating element 220, that is, the one side F1 and the other side F2 in the oscillation operating direction of the operating element 220 in the housing 210, such mechanisms can be arranged in a dispersed manner without being concentrated at the central part of the housing 210. A slim switch 200 in which the width direction of the housing 210 is narrowed thus can be configured.

The second power supply switch mechanism 290 has a configuration same as the first power supply switch mechanism 280. Furthermore, the parallel arrangement configuration in which the first power supply switch mechanism 280 and the second power supply switch mechanism 290 simultaneously receive the operation force of one operating element 220 is adopted. Thus, the second power supply switch mechanism 290 has a function same as the first power supply switch mechanism 280, and is simultaneously executed with the ON/OFF operation.

Therefore, the components same as each component of the first power supply switch mechanism 280 are arranged in the second power supply switch mechanism 290. Because the configuring components are the same, the description of the second power supply switch mechanism 290 including the first spring coupling body 291, the movable piece 292, the fixed terminal 293, the common fixed terminal 294, and each contact 296, 297 is made in the first power supply switch mechanism 280 and hence will not be repeated.

Figure 12A:
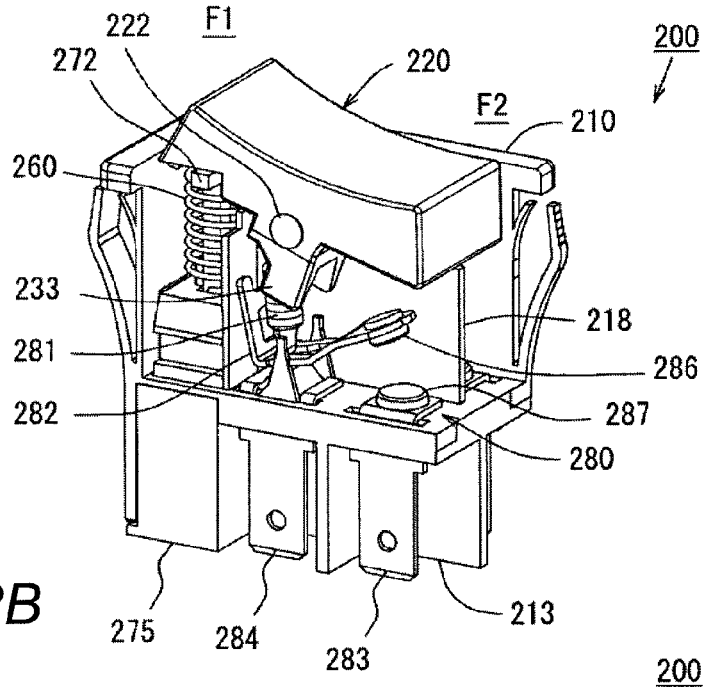
FIGS. 12A and 12B are perspective views of the main parts showing a power supply switch mechanism of the second embodiment in partially cross-section.
Figure 12B:
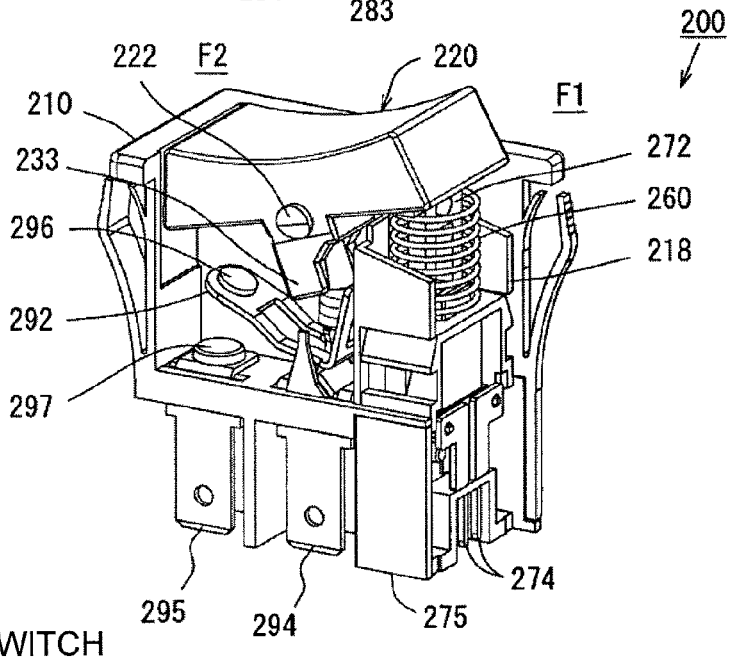

As shown in FIGS. 12A and 12B, the first power supply switch mechanism 280 and the second power supply switch mechanism 290 are partitioned by the first partition plate 218 in the housing 210. Thus, each switch mechanism 280, 290 ensures one partitioned switch operation space by the inner wall of the housing 210 and the partition plate 218.

Figure 13A:
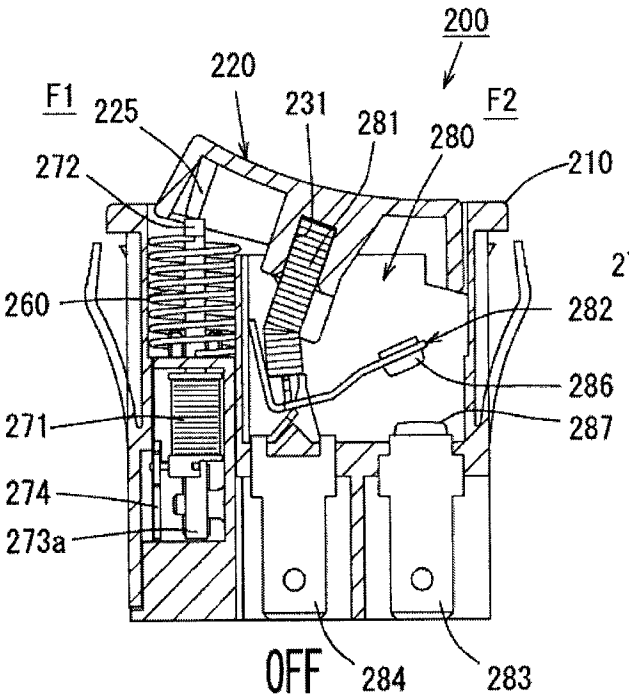
FIGS. 13A and 13B are perspective views of the main parts showing the open/close state of the power supply switch mechanism of the second embodiment.
Figure 13B:
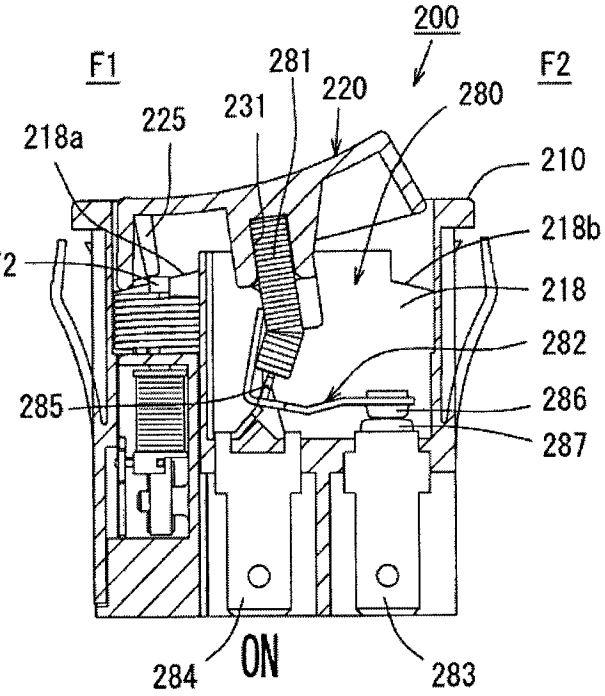

Furthermore, the partition plate 218 has the upper surface acting as the stopper surface for regulating the turn of the operating element 220 to one side F1 and the other side F2, where an ON-stopper surface 218*a* is formed in an inclined manner on the upper surface of the partition plate 218 facing the one side of the operating element 220, as shown in FIG. 13B. Furthermore, an OFF stopper surface 218*b* is formed in an inclined manner on the upper surface of the partition plate 218 facing the other side of the operating element 220.

The return spring 260 is configured by a coil spring. As shown in FIG. 13A, the return spring 260 is normally extended to push up the operating element 220 through the movable magnetic piece 272 and turned in the OFF direction.

The power supply reset mechanism 270 is configured to include the solenoid 271, the movable magnetic piece 272, the permanent magnet 273, the fixed magnetic piece (yoke) 273*a*, the reset signal input terminal 274, and the solenoid case 275.

The solenoid 271 includes an inserting portion opened in the up and down direction by winding a coil around the outer peripheral surface, where the movable magnetic piece 272, to be described later, is inserted in the up and down direction into such an inserting portion. Furthermore, the permanent magnet 273, the fixed magnetic piece 273*a*, and the reset signal input terminal 274 are arranged facing each other on the inner end side of the inserted movable magnetic piece 272.

The movable magnetic piece 272 has a T-shape, where the lower side of the T-shaped portion is arranged to be freely insertable to the inserting portion, parallel in two columns, of the solenoid 271 in two parallel columns. The return spring 260 is interposed in a state compressed in the up and down direction between the lower surface step portion of the T-shape of the movable magnetic piece 272 and the coil side upper end face of the solenoid 271, as shown in FIGS. 12A and 12B.

When the operating element 220 is ON operated, the movable magnetic piece 272 receives the downward pushing force through the pushing element 225, and the movable magnetic piece 272 moves downward against the biasing force of the return spring 260. When the movable magnetic piece 272 reaches the lower end, it is adsorbed and held by the rectangular solid permanent magnet 273 facing on the lower side and the U-shaped fixed magnetic piece 273*a* arranged on both sides with the permanent magnet 273 in the middle. The power ON state is held by the adsorbing and holding effect. When the magnetism release action is applied on the solenoid 271 in the power ON state, the release function of releasing the adsorption and turning OFF the power supply is provided.

FIG. 13A shows the OFF state of the first power supply switch mechanism 280, and FIG. 13B shows the ON state. As shown in FIG. 13A, normally when the first power supply switch mechanism 280 is in the OFF state, the return spring 260 is extended, the upper end of the movable magnetic piece 272 biased by the return spring 260 pushes up the operating element 220 through the pushing element 225, and the operating element 220 is biased and supported at the OFF position. In this case, the operating element 220 is in a state turned in the OFF direction. In the OFF state, the first spring coupling body 281 is bent to an arch shape in the power OFF direction, the L shaped movable piece 282 is turned in the OFF direction with the bent portion as the supporting point of turn, and the power OFF state in which the contact 286 of the movable piece 282 is spaced apart from the contact 287 of the fixed terminal 283 is obtained.

If the switch 200 configured as above is ON operated, when the operating element 220 is pushed in the ON direction as shown in FIG. 13B, the pushing element 225 of the operating element 220 pushes down the movable magnetic piece 272 against the biasing force of the return spring 260. The movable magnetic piece 272 thus moves downward and is inserted to the inserting portion of the solenoid 271, and adsorbed upon receiving the magnetic attracting action of the permanent magnet 273 and the fixed magnetic piece 273*a* facing on the lower side. In this case, the return spring 260 is compressed, and the ON state is held by the magnetism adsorption action in the compressed state. The middle part in the axial direction of the first spring coupling body 281 of the first power supply switch mechanism 280 is flipped backward when the operating element 220 is ON operated, where the movable piece 282 is turned by the reactive force thereof thus bringing the contacts 286, 287 into contact and turning ON the power supply.

The second power supply switch mechanism 290 also moves same as the movement of the first power supply switch mechanism 280, and is ON operated in synchronization.

The power ON state is held until the reset signal is input from the control unit to the solenoid 271.

The switch configured as above has the power supply switch mechanism 240 including the first power supply switch mechanism 280 and the second power supply switch mechanism 290, and the power supply reset mechanism 270 separated in the operating direction on one side F1 and the other side F2 in the housing 210, and hence such mechanisms can be dispersed without being concentrated at the central part of the housing 210. A slim switch 200 in which the width direction of the housing is narrowed thus can be formed.

Furthermore, the planar arrangement space seen from the stacking direction can be reduced because the configuring components are stacked on the power supply reset mechanism 270 side. Thus, a compact arrangement configuration in which the occupying area of the power supply reset mechanism 270 can be realized and the switch can be reliably miniaturized.

On the power supply switch mechanism 240 side, the movable pieces 282, 292 are arranged folded to an L shape and the like, and hence the movable piece 282, 292 having the vicinity of the folding as the supporting point of turn becomes the turning trajectory of substantially the radius length, and the occupying space in the turning of the movable piece can be reduced. The movable piece itself thus can be incorporated compactly in the housing, so that the housing 210 can be miniaturized and the miniaturization of the switch can be further achieved.

Figure 14A:
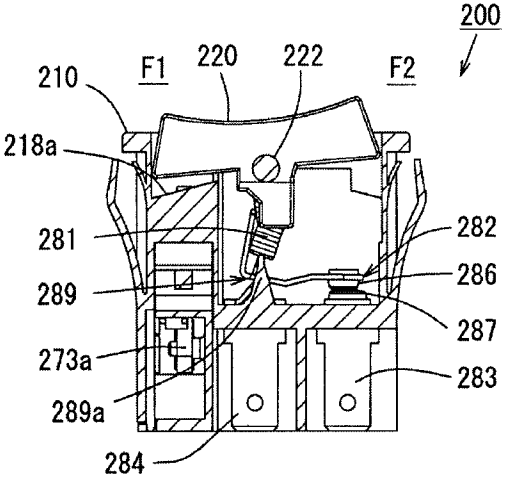
FIGS. 14A to 14C are explanatory views of a switch showing the wiping operation of the movable piece of the second embodiment in cross-section.
Figure 14B:
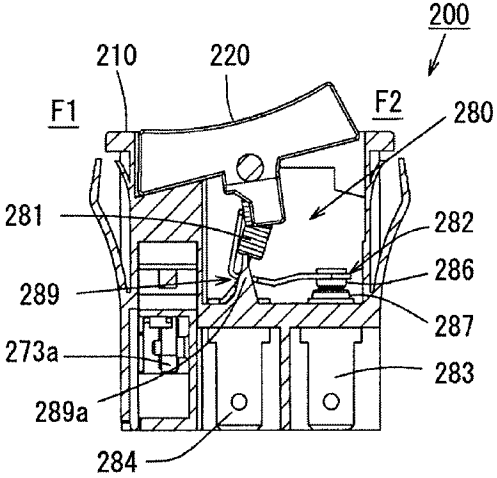
Figure 14C:
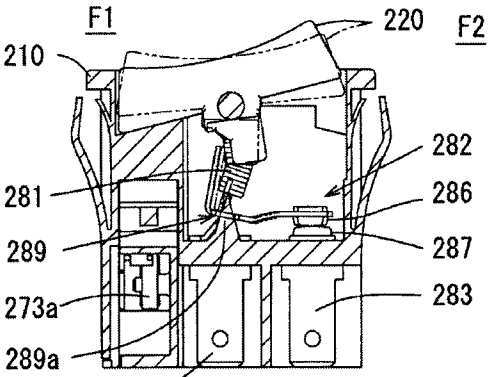

FIGS. 14A to 14C show the wiping processing operation using the first power supply switch mechanism 280. FIG. 14A is a longitudinal cross-sectional view of a switch showing the initial contact state of before wiping between the contacts of the movable piece and the fixed terminal, FIG. 14B is a longitudinal cross-sectional view of a switch showing the contact state of after wiping between the contacts of the movable piece and the fixed terminal, and FIG. 14C is a longitudinal cross-sectional view of a switch showing a state in which the movable piece is slid and moved.

The movable piece 282 arranged in the first power supply switch mechanism 280 is supported in a freely turnable manner by a displacement supporting portion 289 for slidably moving the movable piece 282 in a direction substantially orthogonal to the contacting and separating direction of the contacts 286, 287 at the time of initial contact (see FIG. 14A) when the contact 286 of the movable piece 282 is brought into contact with the contact 287 of the fixed terminal 283 in cooperation with the ON operation of the operating element 220.

The displacement supporting portion 289 turnably supports the movable piece 282 so as to sandwich the horizontal piece side of the movable piece having an L shape with a turn supporting piece 289*a* on both sides upstanding in parallel so as to sandwich both sides of the movable piece 282. Both sides where the movable piece 282 is supported in a freely turning manner is cut out to a recessed groove form and cut out slightly longer to the horizontal piece side to permit the movable piece 282 to slide in the horizontal direction.

In a state the contacts 286, 287 are in contact with each other, the slidable movement of the movable piece 282 is promoted while supporting at an inclination angle that becomes an inclined position in which the distal end side of the L-shaped horizontal piece of the movable piece is inclined downward. Therefore, when the operating element is ON operated, the movable piece 282 slightly slidable moves in the horizontal direction with the turning of the movable piece 282 (see FIG. 14B).

In this case, the contact 286 of the movable piece 282 slidably comes into contact with the contact 287 of the fixed terminal 283 over a constant length (see FIG. 14C). The so-called wiping operation is executed. The welding avoiding performance is constantly obtained between the contacts by such a wiping operation.

Figure 15A:
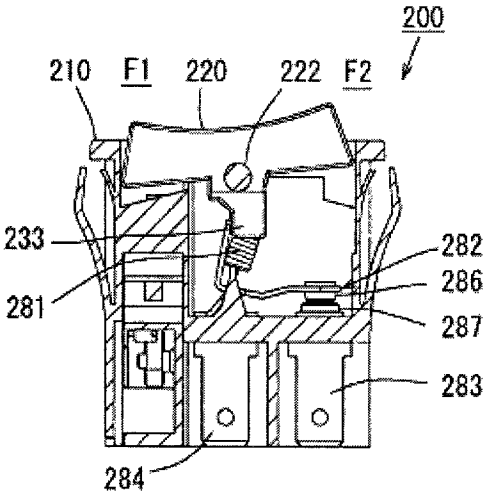
FIGS. 15A to 15C are explanatory views of a switch showing a welding dissociating operation of the contact of the second embodiment.
Figure 15B:
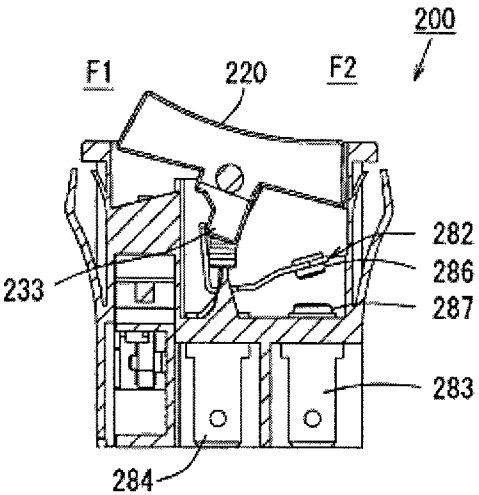
Figure 15C:
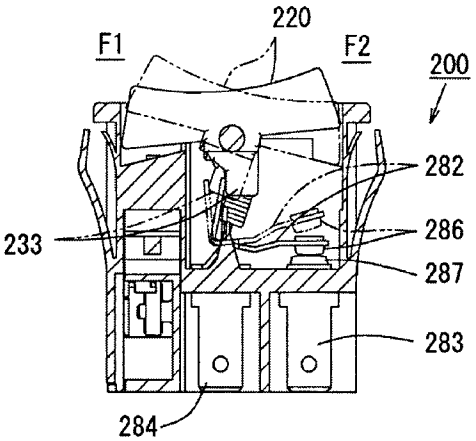

FIGS. 15A to 15C show the welding avoiding operation using the first power supply switch mechanism 280. FIG. 15A is a longitudinal cross-sectional view of a switch showing a state before the welding dissociation in which the contacts are welded, FIG. 15B is a longitudinal cross-sectional view of a switch showing a state after the welding dissociation in which the welding is forcibly dissociated by the operating element, and FIG. 15C is a longitudinal cross-sectional view of a switch showing a state from the time of welding to the dissociation of welding of the movable piece in a synthesized manner.

The operating element 220 includes the forced pressurization piece 233, where the movable piece 282 is forcibly pressurized in a direction the contact 286 of the movable piece 282 separates from the contact 287 of the fixed terminal 283 upon receiving the operation force of the operating element 220 at which the operating element 220 is OFF operated.

As shown in FIG. 15A, when the contacts 286, 287 are welded, if the forced pressurization piece 233 starts to operate the operating element 220 in the OFF direction, the turning resistance of the operating element 220 becomes stronger, a smooth turning is regulated and the OFF operation cannot be carried out by the welding effect of the contacts 286, 287. In this case, when the operating element 220 is further pushed in the OFF operating direction stronger, as shown in FIG. 15B, the forced pressurization piece 233 strongly pushes the L shaped vertical piece side of the movable piece 282 in the OFF direction for forced pressurization. The contacts are thus separated and forcibly separated although they are welded to OFF operate the power supply.

In the correspondence of the configuration of one or more embodiments of the present invention described above, the power supply holding release mechanism of one or more embodiments of the present invention corresponds to the power supply reset mechanisms 170, 270 of the embodiments, the forced pressurization portion corresponds to the forced pressurization piece 233, the holding portion corresponds to the permanent magnet 173, 273 and the fixed magnetic piece 173*a*, 273*a*, the releasing portion corresponds to the solenoids 171, 271, and the elastic body corresponds to the spring coupling bodies 181, 191, 281, 291, where the present invention is not limited only to the configuration of the above described embodiments.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A switch comprising:

an operating element supported by a housing and oscillation operated to one side and an other side;

a power supply switch mechanism for bringing contacts of a movable piece and a fixed terminal facing each other in the housing into contact with each other when the operating element is oscillation operated to one side;

a return spring for biasing the operating element in an oscillation operating direction when the operating element is oscillation operated to the other side;

a power supply holding release mechanism configured by a holding portion for holding a contact state of the contacts of the movable piece and the fixed terminal by regulating the return spring in an anti-biasing direction when the operating element is oscillation operated to one side; and a releasing portion for releasing the contact state held by the holding portion, wherein the power supply switch mechanism, the return spring, and the power supply holding release mechanism are arranged in an internal space of the housing, and wherein the power supply holding release mechanism is arranged on the one side in the oscillation operating direction of the operating element and the power supply switch mechanism is arranged on the other side in the oscillation operating direction of the operating element.

2. The switch according to claim 1, wherein the return spring, the holding portion, and the releasing portion of the power supply holding release mechanism are stacked;

wherein the movable piece of the power supply switch mechanism is arranged to be supported in a freely turning manner in the operating direction of the operating element in a folded shape being folded in the operating direction of the operating element; and wherein a central part in the operating direction, in which the operating element is operated, and the movable piece are coupled by an elastic body which is inverted based on the oscillation operation of the operating element.

3. The switch according to claim 1, wherein the power supply switch mechanism further comprises:

a displacement supporting portion for slidably moving the movable piece in a direction substantially orthogonal to a direction in which contacts come into contact with and separate from each other at an initial contact when the contact of the movable piece is brought into contact with the contact of the fixed terminal.

4. The switch according to claim 1, wherein the operating element is configured to further comprise:

a forced pressurization portion for forcibly pressurizing the movable piece in a direction the contact of the movable piece moves away from the contact of the fixed terminal upon receiving the operation force of the operating element at which the operating element is oscillation operated to the other side.

5. An electronic device comprising the switch according to claim 1.

6. The switch according to claim 1, wherein the power supply switch mechanism further comprises:

a displacement supporting portion for slidably moving the movable piece in a direction substantially orthogonal to a direction in which contacts come into contact with and separate from each other at an initial contact when the contact of the movable piece is brought into contact with the contact of the fixed terminal.

7. The switch according to claim 2, wherein the operating element is configured to further comprise:

a forced pressurization portion for forcibly pressurizing the movable piece in a direction the contact of the movable piece moves away from the contact of the fixed terminal upon receiving the operation force of the operating element at which the operating element is oscillation operated to the other side.

8. The switch according to claim 3, wherein the operating element is configured to further comprise:

a forced pressurization portion for forcibly pressurizing the movable piece in a direction the contact of the movable piece moves away from the contact of the fixed terminal upon receiving the operation force of the operating element at which the operating element is oscillation operated to the other side.

9. The switch according to claim 6, wherein the operating element is configured to further comprise:

a forced pressurization portion for forcibly pressurizing the movable piece in a direction the contact of the movable piece moves away from the contact of the fixed terminal upon receiving the operation force of the operating element at which the operating element is oscillation operated to the other side.

10. An electronic device comprising the switch according to claim 9.

* * * * *